US007423604B2

(12) United States Patent
Nagai

(10) Patent No.: US 7,423,604 B2
(45) Date of Patent: Sep. 9, 2008

(54) WAVEGUIDE HORN ANTENNA ARRAY AND RADAR DEVICE

(75) Inventor: Tomohiro Nagai, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 507 days.

(21) Appl. No.: 11/283,802

(22) Filed: Nov. 22, 2005

(65) Prior Publication Data

US 2006/0158382 A1 Jul. 20, 2006

(30) Foreign Application Priority Data

Jan. 20, 2005 (JP) ..... 2005-013096

(51) Int. Cl.
*H01Q 13/00* (2006.01)

(52) U.S. Cl. ..... 343/776; 343/786

(58) Field of Classification Search ..... 343/772, 343/776, 786

See application file for complete search history.

(56) References Cited

U.S. PATENT DOCUMENTS 4,755,821 A * 7/1988 Itoh et al. ..... 343/700 MS
5,323,169 A * 6/1994 Koslover ..... 343/786
6,476,772 B1 * 11/2002 Smith et al. ..... 343/771
6,606,073 B1 * 8/2003 Visser ..... 343/771

FOREIGN PATENT DOCUMENTS

| | | |
|---|---|---|
| JP | 10-32423 | 2/1998 |
| JP | 2000-9822 | 1/2000 |
| JP | 2004-207856 | 7/2004 |

* cited by examiner

*Primary Examiner*—Shih-Chao Chen
(74) *Attorney, Agent, or Firm*—Dickstein Shapiro LLP

(57) ABSTRACT

A conductor member contains a linear feed waveguide extending in a fixed direction and a plurality of horn antennas coupled to the feed waveguide and set at an interval of about one half of a wavelength in the extending direction of the feed waveguide. The horn antennas are formed by horns and coupling waveguides, and the coupling waveguides are set so as to partially enter the feed waveguide. When the size of the spatial coupling portion formed by the entrance is changed, the degree of coupling between the feed waveguide and each of the coupling waveguides changes.

11 Claims, 18 Drawing Sheets

WAVEGUIDE HORN ANTENNA ARRAY AND RADAR DEVICE

BACKGROUND OF THE INVENTION

1. Field of the Invention

The present invention relates to a waveguide horn antenna array having a plurality of waveguide horn set in a feed waveguide with a fixed arrangement pattern and a radar device for performing target detection by using the antenna.

2. Description of the Related Art

In radar devices, etc., using the millimeter waveband, by utilizing the fact that transmission loss is less in waveguides than in planar circuits such as microstrip lines, etc., waveguide antenna arrays are used more than planar-circuit type antenna arrays.

Among related waveguide antenna arrays, as shown in Japanese Unexamined Patent Application Publication No. 10-32423, a connection waveguide is connected by T-branching in a perpendicular manner to one wall surface of a feed waveguide. Furthermore, as shown in Japanese Unexamined Patent Application Publication No. 2000-9822, the extending direction of a feed waveguide is perpendicular to the extending direction of a plurality of connection waveguides connected to horns. Correspondingly, one side wall of the feed waveguide is in contact with one side wall of the connection waveguide, and a coupling hole is formed in the wall contacting with the other wall.

However, in the related waveguide antenna arrays described in the above Japanese Unexamined Patent Application Publication No. 10-32423 and Japanese Unexamined Patent Application Publication No. 2000-9822, the degree of coupling between the feed waveguide and the connection waveguide is dependent on the opening area of the coupling hole formed in the plane surface portion where the waveguides are connected to each other. On the other hand, the shape of the feed waveguide and the connection waveguide is decided by a millimeter wave signal to be transmitted, the connection area between the feed waveguide and the connection waveguide is not large, the coupling hole is formed in the connection portion, and accordingly, the shape of the coupling hole is naturally limited. In this way, in the structure where the feed waveguide and the connection waveguide are coupled by forming a coupling hole on the connection surface, the adjustment range of the degree of coupling cannot be increased.

Furthermore, in the waveguide antenna array described in Japanese Unexamined Patent Application Publication No. 2000-9822, since many parts are required and the structure becomes complicated, it is difficult to form a waveguide antenna array of small size.

SUMMARY OF THE INVENTION

Accordingly, it is an object of the present invention to provide a waveguide horn antenna array in which the adjustment range of the degree of coupling is wide and the structure is simple.

In the present invention, a waveguide horn antenna array comprises a feed waveguide; and a plurality of horn antennas having a plurality of coupling waveguides with an electromagnetic wave propagation direction in the direction perpendicular to an electromagnetic wave propagation direction of the feed waveguide, and having horns set in the end portion opposite to the feed waveguide, of the plurality of coupling waveguides. In the waveguide horn antenna array, the plurality of horn antennas are set in a fixed arrangement to the feed waveguide, and the plurality of horn antennas are set in such a way that the end portion, on the side where the horn is not set, of the coupling waveguide is partially protruded into the feed waveguide in the direction perpendicular to the extending direction of the feed waveguide.

In the structure, a plurality of coupling waveguides partially enters a feed waveguide, that is, a plurality of coupling waveguides cuts into a feed waveguide. Accordingly, a coupling space area held in common by the feed waveguide and the plurality of coupling waveguides is formed. When a signal is propagated to the feed waveguide, the propagation signal (electromagnetic wave) leaks from the feed waveguide to the coupling waveguides due to disturbance of the signal transmission line caused by the coupling space area. The leak signal is propagated in the coupling waveguides and led to the horns, and finally radiated to the outside from the horns. At this time, since the feed waveguide and the coupling waveguides are coupled in a spatial area, that is, three-dimensional area, the degree of coupling is set by the amount of protrusion in two directions. The two directions are the direction perpendicular to the extending direction of the feed waveguide and in parallel to the extending direction of the coupling waveguides and the direction perpendicular to the extending direction of the feed waveguide and perpendicular to the extending direction of the coupling waveguides.

Furthermore, in a waveguide horn antenna array of the present invention, the opening surface of the feed waveguide and the opening surface of the plurality of coupling waveguides have the long side and the short side perpendicular to the extending direction of the waveguides, respectively, and the plurality of coupling waveguides are set to the feed waveguide so that the direction of the long side of the feed waveguide and the direction of the long side of the plurality of coupling waveguides may make a fixed angle.

In the structure, the relation between the polarization direction of an electromagnetic wave propagated in the feed waveguide and the polarization direction of an electromagnetic wave propagated in the coupling waveguides and radiated from the horn is set by the fixed angle.

Furthermore, in a waveguide horn antenna array of the present invention, the plurality of coupling waveguides are disposed at an interval of about one half of the wavelength of a signal being propagated in the feed waveguide in the extending direction of the feed waveguide, and neighboring coupling waveguides in the extending direction of the feed waveguide are disposed in the end portion, opposite to each other, in the direction perpendicular to the extending direction of the feed waveguide.

In the structure, when the plurality of coupling waveguides are disposed at an interval of about one half of the wavelength to the feed waveguide and disposed at the horn distance shorter than the wavelength in the free space, the phase of radiation from each horn antenna becomes uniform and an antenna having no grating robe and a high radiation efficiency can be realized.

Furthermore, in a waveguide horn antenna array of the present invention, the plurality of horn antennas are set to the feed waveguide so that the radiation direction of an electromagnetic wave may be perpendicular to the E-plane of the feed waveguide, and the feed waveguide is divided into two parts by the E-plane.

In the structure, since the feed waveguides and the plurality of horn antennas are formed by a plurality of conductor plates divided by the E-plane, there is little leakage of electromagnetic waves from the divided surfaces and the structure can be simplified.

Furthermore, in a waveguide horn antenna array of the present invention, a plurality of dielectric lenses are contained in the opening portion of the plurality of horn antennas and the plurality of dielectric lenses are integrally formed.

In the structure, radiation characteristics are improved by a dielectric lens contained in the opening portion of the horn antenna and, in addition, the structure is simplified by the integrally formed dielectric lens.

Furthermore, a radar device of the present invention contains the waveguide horn antenna array and a target detection is performed by using an electromagnetic wave transmitted and received by the waveguide horn antenna array.

In the structure, the distance to a target is observed from an electromagnetic wave (transmission signal) transmitted by a waveguide horn antenna array and an electromagnetic wave (reception signal) reflected from the target received by the waveguide horn antenna array.

According to a preferred embodiment of the present invention, since the degree of coupling is adjusted in accordance with the three-dimensional protrusion between a feed waveguide and a coupling waveguide, the degree of coupling can be more widely adjusted than in the related plane arrangement. That is, a waveguide horn antenna array arrangement having a wide coupling adjustment width can be constructed. In addition, since the feed waveguide and the coupling waveguide are simply protruded into each other, a waveguide horn antenna array having a simple structure and a wide coupling adjustment width can be constructed.

According to a preferred embodiment of the present invention, the polarization direction of an electromagnetic wave transmitted in a feed waveguide and the polarization direction of an electromagnetic wave transmitted in a coupling waveguide can be freely changed. In this way, regardless of the propagation direction and polarization direction of an electromagnetic wave supplied to the feed waveguide, the polarization direction of an electromagnetic wave to be radiated can be set.

Furthermore, according to a preferred embodiment of the present invention, since the horns are arranged at an interval of about one half of the wavelength of a signal in the feed waveguide, the spacing between the horns is made shorter than the wavelength in the free space, the grating robe is eliminated, and accordingly, excellent radiation characteristics can be realized.

Furthermore, according to a preferred embodiment of the present invention, since the feed waveguides and the horn antennas are formed by a plurality of conductor plates due to division by the E-plane, without making transmission characteristics of the feed waveguides deteriorated, a waveguide horn antenna array of a simple structure of parts can be constructed.

Furthermore, according to a preferred embodiment of the present invention, by using an integrally formed dielectric lens, a waveguide horn antenna array having more excellent radiation characteristics and a simple structure can be constructed.

Furthermore, according to a preferred embodiment of the present invention, since the transmission and reception of an electromagnetic wave signal for detection of a target are performed by using the waveguide horn antenna array, a radar device simultaneously having a simple structure and an excellent detection capability can be constructed.

Other features, elements, characteristics and advantages of the present invention will become more apparent from the following detailed description of preferred embodiments of the present invention with reference to the attached drawings.

DESCRIPTION OF THE PREFERRED EMBODIMENTS

A waveguide horn antenna array according to an embodiment of the present invention is described with reference to FIGS. 1 to 15.

Figure 1:
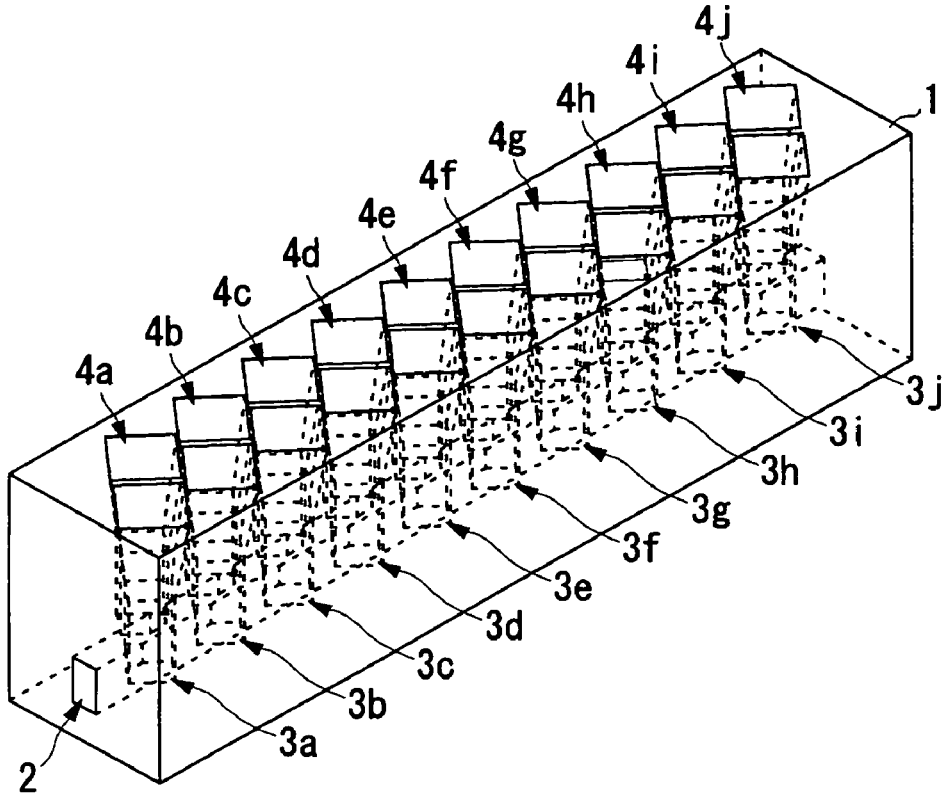
FIG. 1 is an external perspective view showing the outline of the structure of a waveguide horn antenna array of the present invention.
Figure 2:
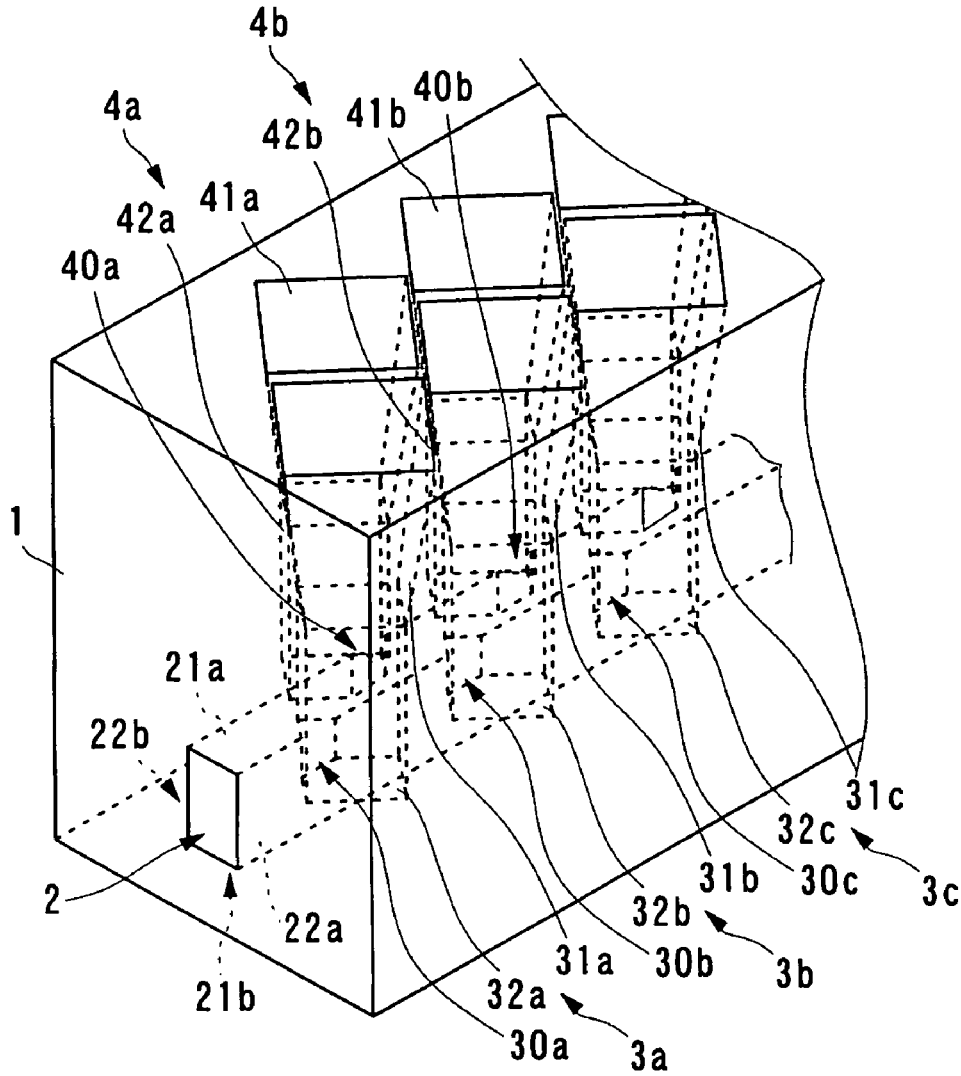
FIG. 2 is a partially expanded perspective view of the waveguide horn antenna array shown in FIG. 1.
Figure 3A:
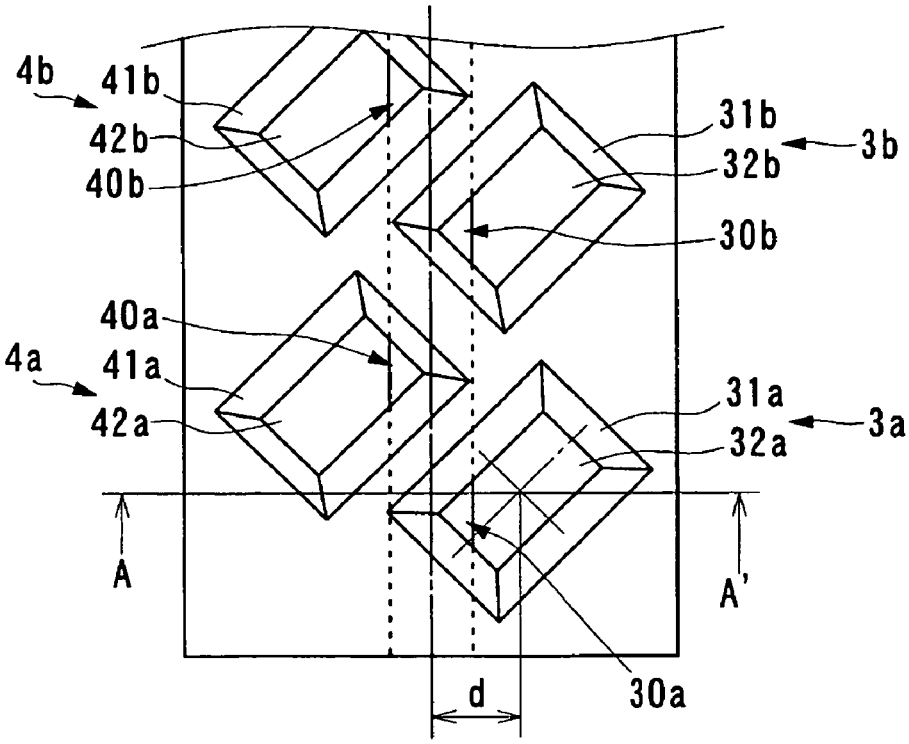
FIG. 3A is a partially expanded top view of the waveguide horn antenna array shown in FIG. 1.
Figure 3B:
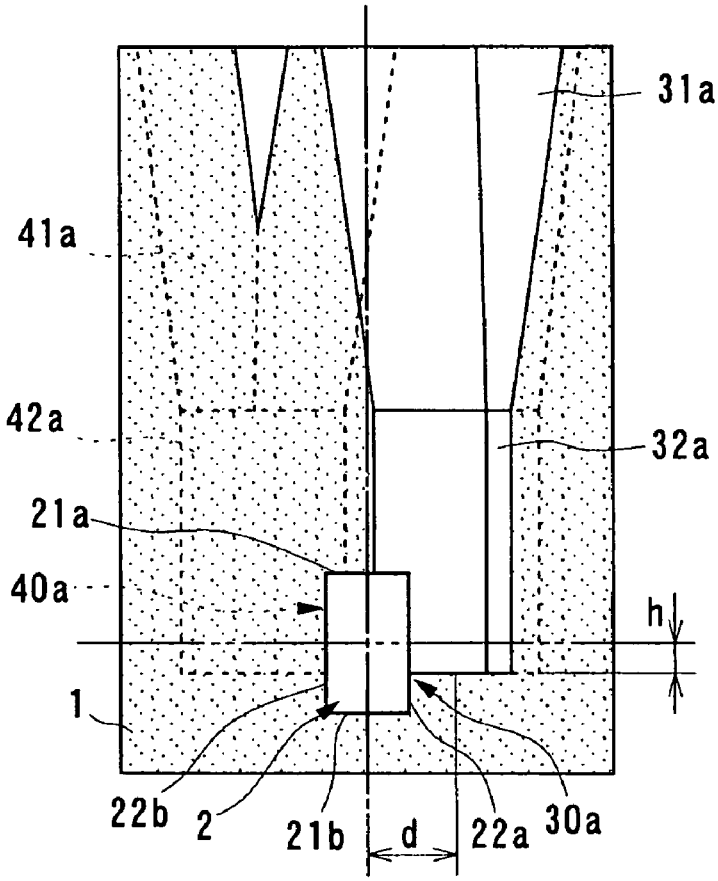
FIG. 3B is a sectional view taken on line A-A in FIG. 3A.

FIG. 1 is an external perspective view showing the outline of the structure of a waveguide horn antenna array of the present invention. FIG. 2 is a partially expanded perspective view of the waveguide horn antenna array shown in FIG. 1. FIG. 3A is a partially expanded top view of the waveguide horn antenna array shown in FIG. 1, and FIG. 3B is a sectional view taken along line A-A' in FIG. 3A.

The waveguide horn antenna array of the present invention contains a feed waveguide 2 extending in a fixed direction and horn antennas 3*a* to 3*j* and 4*a* to 4*j* each coupled to the feed waveguide 2. The feed waveguide 2 and the horn antennas 3*a* to 3*j* and 4*a* to 4*j* are formed in a conductor member 1.

The feed waveguide 2 extends in a fixed direction and is formed in accordance with the shape of the conductor member 1, and the section perpendicular to the extending direction of the feed waveguide 2 is rectangular. That is, the feed waveguide 2 is composed of a rectangular waveguide in which the plane in parallel to the planes 22*a* and 22*b* along the long side of the rectangle is made as an H-plane, the plane in parallel to the planes 21*a* and 21*b* along the short side of the rectangle is made as an E-plane, and a TE10 mode electromagnetic wave is propagated in the extending direction of the waveguide. Furthermore, the feed waveguide 2 is made open in one surface of the conductor member 1 (this is the left side in FIGS. 1 and 2) and the feed waveguide 2 has a terminating surface at a fixed distance from the other surface (back right side in FIG. 1), opposite to the one surface.

The horn antennas 3*a* to 3*j* and 4*a* to 4*j* each are composed of coupling waveguides 32*a* to 32*j* and 42*a* to 42*j* and horns 31*a* to 31*j* and 41*a* to 41*j*.

The coupling waveguides 32*a* to 32*j* and 42*a* to 42*j* are rectangular in section, extend in substantially the same direction, and are formed so as to be perpendicular to the extending direction of the feed waveguide 2. The extending direction of the coupling waveguides 32*a* to 32*j* and 42*a* to 42*j* is perpendicular to the direction perpendicular to the E-plane of the feed waveguide 2 (the direction in parallel to the H-plane). The coupling waveguides 32*a* to 32*j* and 42*a* to 42*j* each also propagate a TE10 mode electromagnetic wave in the extending direction of the waveguide in the same way as the feed waveguide 2. Furthermore, the coupling waveguides 32*a* to 32*j* and 42*a* to 42*j* which are disposed at an interval of about one half of the wavelength in the feed waveguide in the extending direction of the feed waveguide 2, are coupled to the feed waveguide 2 in the order of 32*a*, 42*a*, 32*b*, 42*b*, . . . , 32*j*, 42*j* from the side of the opening surface of the feed waveguide 2. Among the coupling waveguides 32*a* to 32*j* and 42*a* to 42*j* arranged in this way, the innermost coupling waveguide 42*j* from the opening surface of the feed waveguide 2 is coupled to the feed waveguide 2 at a fixed distance from the terminating surface of the feed waveguide 2.

Furthermore, the coupling waveguides 32*a* to 32*j* are coupled to the edge portion between one surface 21*a* in parallel to the direction of the short side of the feed waveguide 2 and one surface 22*a* in parallel to the direction of the long side, and the coupling waveguides 42*a* to 42*j* are coupled to the edge portion between one surface 21*a* in parallel to the direction of the short side of the feed waveguide 2 and one surface 22*b* in parallel to the direction of the long side. That is, the coupling waveguides 32*a* to 32*j* and 42*a* to 42*j* are set so as to be alternately coupled to both sides in parallel to the extending direction of the feed waveguide 2 on one surface 21*a* in parallel to the direction of the short side of the opening surface of the feed waveguide 2. In other words, the coupling waveguides 32*a* to 32*j* and 42*a* to 42*j* are coupled in order in the extending direction of the feed waveguide 2 so as to be in a zigzag pattern. Moreover, the coupling waveguides 32*a* to 32*j* and 42*a* to 42*j* are coupled to the feed waveguide 2 in such a way that the direction of the long side of the opening surface of the coupling waveguides 32*a* to 32*j* and 42*a* to 42*j* and the direction of the long side of the opening surface of the feed waveguide 2 make a fixed angle (substantially 45 degrees in FIGS. 1 to 3).

Furthermore, the coupling waveguides 32*a* to 32*j* and 42*a* to 42*j* each are coupled to the feed waveguide 2 so as to cut in with a fixed length in the direction parallel to the long side of the opening surface of the feed waveguide 2 and in the direction parallel to the short side of the opening surface of the feed waveguide 2 and the spatially coupled portions 30*a* to 30*j* and 40*a* to 40*j* (in FIG. 2, only the spatially coupled portions 30*a*, 30*b*, 30*c*, 40*a*, and 40*b* are illustrated, and the illustration of the other spatially coupled portions is omitted) are formed. The amount of a cut-in of the coupling waveguides 32*a* to 32*j* and 42*a* to 42*j* to the feed waveguide 2, that is, the degree of coupling is appropriately set in accordance with desired radiation characteristics. At this time, the whole end portions, on the side of the feed waveguide 2, of the coupling waveguides 32*a* to 32*j* and 42*a* to 42*j* do not cut in the feed waveguide 2, but the end portions partially cut in the feed waveguide 2.

The horns 31*a* to 31*j* and 41*a* to 41*j* each are set at the end portion, opposite to the end portion coupling to the feed waveguide 2, of the coupling waveguides 32*a* to 32*j* and 42*a* to 42*j*, and the horns 31*a* to 31*j* and 41*a* to 41*j* are formed in such a way that the surface perpendicular to the extending direction from the opening surface on the side of the coupling waveguide 2 to the opening surface, made open to the outside, of the conductor member 1 is gradually expanded. At this time, the horns 31*a* to 31*j* and 41*a* to 41*j* are set so that the direction perpendicular to the opening surface, on the side of the horn, of the coupling waveguides 32*a* to 32*j* and 42*a* to 42*j* may be in agreement with the direction perpendicular to the opening surface of the horns 31*a* to 31*j* and 41*a* to 41*j*.

In such a waveguide horn antenna array, an electromagnetic wave is propagated and radiated as described in the following.

Figure 4A:
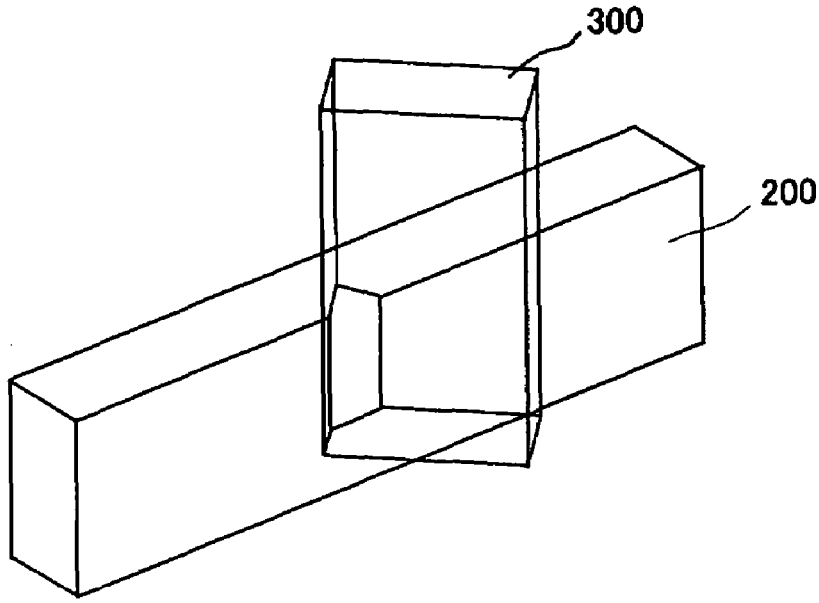
FIGS. 4A and 4B are illustrations for describing the propagation of an electromagnetic wave of the waveguide horn antenna array of the present embodiment.
Figure 4B:
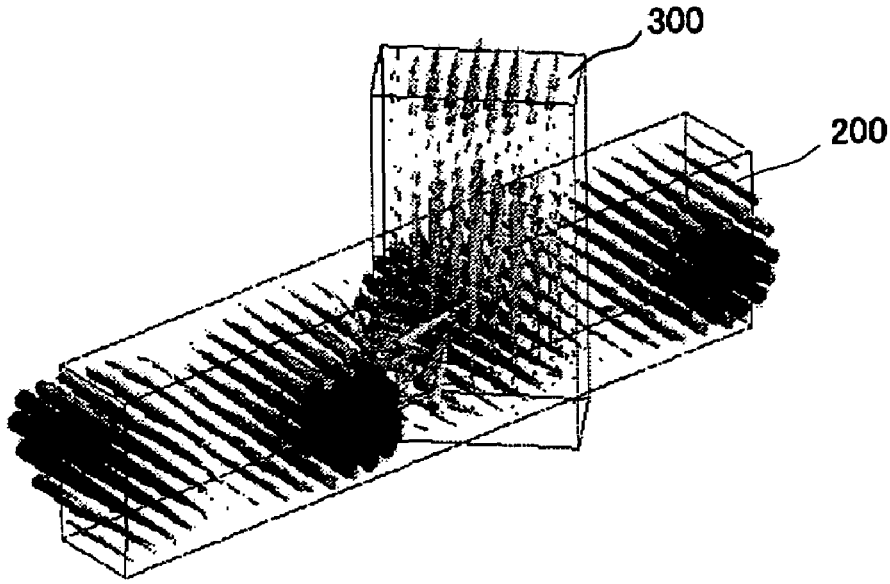

FIGS. 4A and 4B show the propagation of an electromagnetic wave of the waveguide horn antenna array of the present invention, FIG. 4A shows the coupling structure between a feed waveguide 200 and a coupling waveguide 300, and FIG. 4B shows an electric field distribution in the coupling structure shown in FIG. 4A. Moreover, each cone shown in FIG. 4B represents an electric field strength and the direction of the electric field. The feed waveguide 200 in the drawing corresponds to the feed waveguide 2 shown in FIGS. 1 to 3, and the coupling waveguide 300 corresponds to the coupling waveguides 32*a* to 32*j* and 42*a* to 42*j* shown in FIGS. 1 to 3.

When an electromagnetic wave is input to the feed waveguide 200, the electromagnetic wave is propagated in the extending direction of the feed waveguide 200. The electric field distribution in this case becomes a distribution shown in FIG. 4B, and, as described above, a TE01 mode electromagnetic wave is propagated. The electromagnetic wave being propagated in the feed waveguide 200 is propagated to the coupling waveguide 300 coupled to the feed waveguide 200 through a spatially coupling portion. This phenomenon occurs in such a away that the electromagnetic field in the feed waveguide 200 is partially disturbed by a non-conductor-formed portion formed by the spatially coupling portion in the conductor wall of the surface parallel to the direction of the long side and in the conductor wall of the surface parallel to the direction of the short side of the feed waveguide 200 having a rectangular section and that the magnetic field leaks from the spatially coupling portion to the coupling waveguide 300. At this time, the electromagnetic wave being propagated from the feed waveguide 200 to the coupling waveguide 300 can be adjusted by adjustment of the degree of coupling of the coupling waveguide 300 to the feed waveguide 200. Specifically, the degree of coupling is adjusted by the amount of a cut-in of the coupling waveguide 300 to the feed waveguide 200, and the adjustment of the degree of coupling is set by the amount of a cut-in d in the direction parallel to the short side (hereinafter, referred to as the amount of a cut-in in the direction of the short side) in the opening surface of the feed waveguide 200 and the amount of a cut-in h in the direction parallel to the long side (hereinafter, referred to as the amount of a cut-in in the direction of the long side). Here, as shown in FIGS. 3A and 3B, the amount of a cut-in d in the direction of the short side is defined as a distance from the center of the opening surface of the coupling waveguide to the intersection point between the straight line parallel to the direction of the short side of the feed waveguide passing the center and the plane surface perpendicular to the direction of the short side of the feed waveguide including the central axis (extending direction of the feed waveguide) of the opening surface of the feed waveguide. Furthermore, as shown in FIGS. 3A and 3B, the amount of a cut-in h in the direction of the long side is defined as a distance in the direction of the long side of the feed waveguide from the surface a fixed distance away in the direction of the long side of the feed waveguide from the end face of the feed waveguide parallel to the direction of the short side of the feed waveguide, specifically, the E-plane division surface to be described later to the end surface on the feed waveguide of the coupling waveguide.

Figure 5:
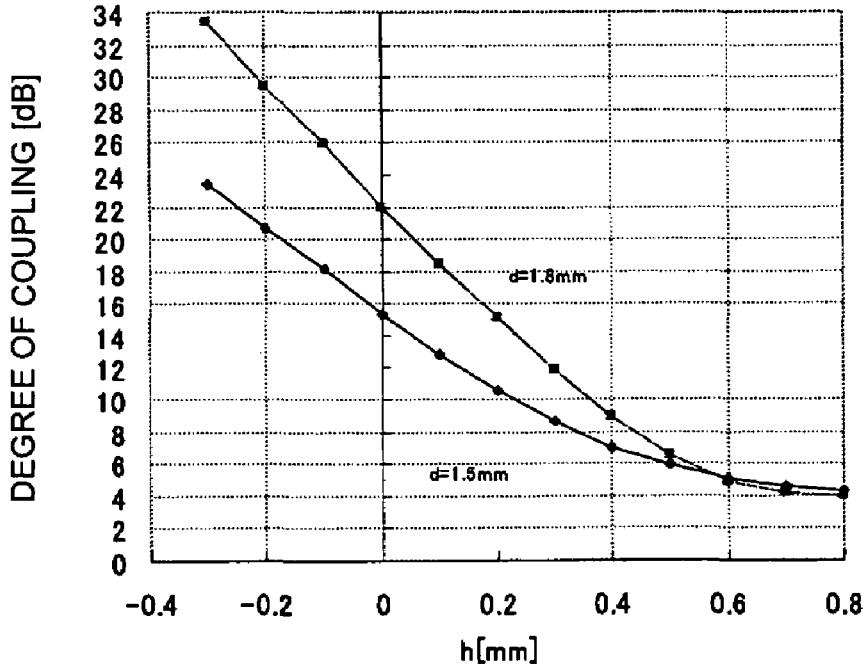
FIG. 5 shows the degree of coupling between a feed waveguide 200 and a coupling waveguide 300 when the amount of a cut-in (d) in the direction of the short side and the amount of a cut-in (h) in the direction of the long side are changed.

The change of the degree of coupling is shown in FIG. 5 when the amount of cut-ins d and h is set in this way.

FIG. 5 shows the degree of coupling between the feed waveguide 200 and the coupling waveguide 300 when the amount of a cut-in d in the direction of the short side and the amount of a cut-in h in the direction of the long side are changed. Moreover, in FIG. 5, regarding the amount of a cut-in h in the direction of the long side, the state where the coupling waveguide 300 cuts in further than the position of the E-plane division is in the plus direction and the state where the coupling waveguide 300 cuts in less than the position of the E-plane division is in the minus direction.

As shown in FIG. 5, when the size of the spatially coupling portion between the feed waveguide 200 and the coupling waveguide 300, that is, when the amount of a cut-in d in the direction of the short side and the amount of a cut-in h in the direction of the long side are changed, the degree of coupling between the feed waveguide and the coupling waveguide changes from about 4 dB to about 34 dB. This corresponds to the change from 0.05% to 40% of the amount of radiation from a horn connected to the coupling waveguide.

In this way, a waveguide horn antenna array, in which radiation characteristics are able to be changed in a wide range, can be constructed by using a simple structure where the coupling waveguides partially cut in the feed waveguide.

Figure 6A:
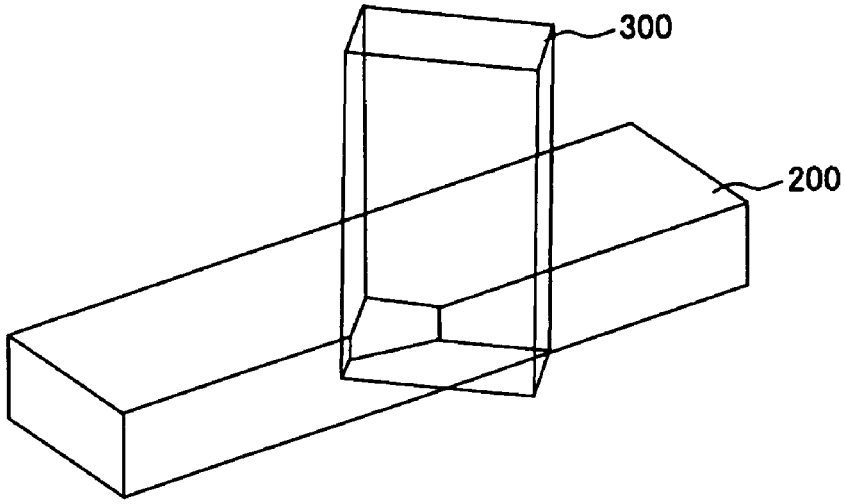
FIGS. 6*a* and 6B are illustrations for showing the propagation of an electromagnetic wave in a waveguide horn antenna array in which the direction of the short side of the feed waveguide and the extending direction of the coupling waveguides are in parallel.

Moreover, in the above description, although a waveguide horn antenna array having the structure in which the direction of the long side of the opening surface of the feed waveguide is parallel to the extending direction of the coupling waveguide was described, as shown in FIG. 6A, regarding a waveguide horn antenna array having a construction where the direction of the short side of the feed waveguide 200 is parallel to the extension direction of the coupling waveguide 300, the above-described structure can be used.

Figure 6B:
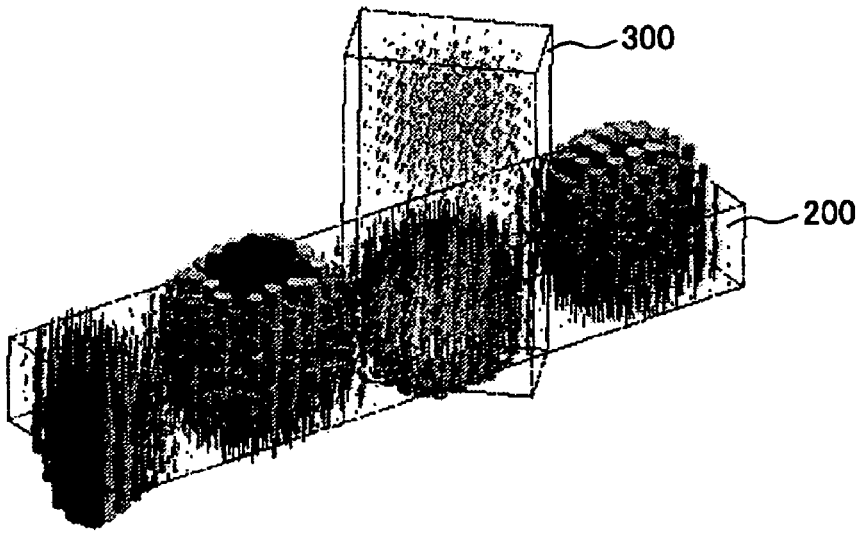

FIGS. 6A and 6B are illustrations showing the propagation of an electromagnetic wave in a waveguide horn antenna array where the direction of the short side of the feed waveguide is parallel to the extending direction of the coupling waveguide, FIG. 6A shows the coupling structure between the feed waveguide 200 and the coupling waveguide 300, and FIG. 6B shows the electric field distribution in the case of the coupling structure shown in FIG. 6A. In this way, even if a waveguide horn antenna array has the structure in which, as shown in FIG. 6A, the direction of the short side of the feed waveguide 200 is made parallel to the extending direction of the coupling waveguide 300, the radiation characteristics can be changed in a wide range by using a simple structure.

Figure 7A:
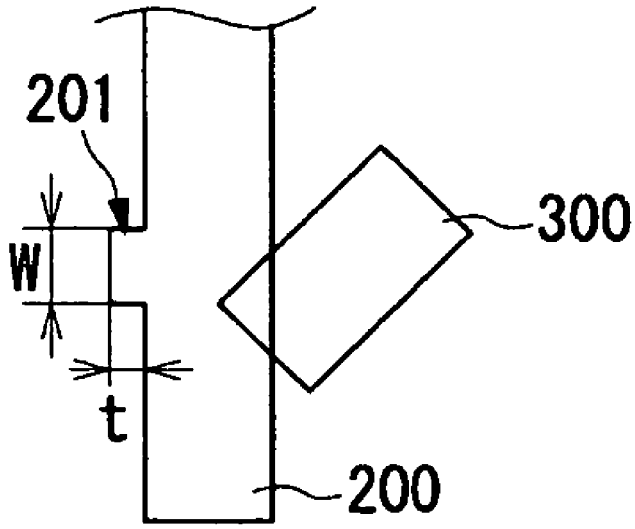
FIG. 7A shows the structure in the vicinity of the coupling portion between a feed waveguide and a coupling waveguide in a second embodiment.
Figure 7B:
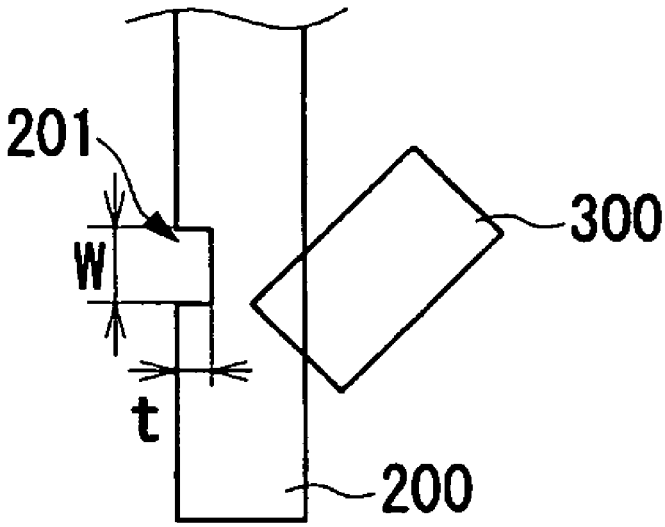
FIG. 7B shows the structure in the vicinity of the coupling portion between a feed waveguide and a coupling waveguide in a third embodiment.

Furthermore, instead of the above-described structure, the structure of feed waveguides as shown in FIGS. 7A and 7B may be used.

FIGS. 7A and 7B show the structure in the vicinity of the coupling portion between a feed waveguide and a coupling waveguide in alternative constructions. FIG. 7A shows a structure in which the feed waveguide near the coupling waveguide is partially thick and FIG. 7B shows a structure in which the feed waveguide near the coupling portion is partially thin.

In the waveguide horn antenna array shown in FIG. 7A, in the vicinity of the coupling portion between the feed waveguide 200 and the coupling waveguide 300, the feed waveguide 200 is formed so as to have a protrusion of a width w in the extending direction and a length t in the direction of the short side. In the waveguide horn antenna array shown in FIG. 7B, in the vicinity of the coupling portion between the feed waveguide 200 and the coupling waveguide 300, the feed waveguide 200 is formed so as to have a concave portion of a width W in the extending direction and a length t in the direction of the short side. When the vicinity of the coupling portion of the feed waveguide 200 is protruded and made hollow in this way, the degree of coupling changes as shown in FIG. 8.

Figure 8:
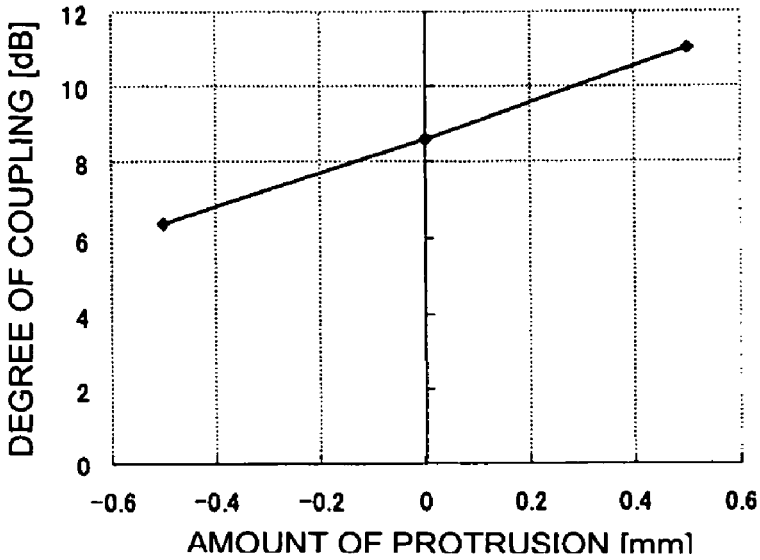
FIG. 8 shows the change of the degree of coupling between a feed waveguide 200 and a coupling waveguide 300 to the amount of protrusion in the vicinity of the coupling portion in the feed waveguide 200.

FIG. 8 shows the change of the degree of coupling between the feed waveguide 200 and the coupling waveguide 300 to the amount of protrusion in the vicinity of the coupling portion of the feed waveguide 200, and the direction of the protrusion is set to be in the plus direction and the direction of the hollow is set to be in the minus direction.

In this way, when the shape in the vicinity of the coupling portion between the feed waveguide 200 and the coupling waveguide 300 is changed, the degree of coupling between the feed waveguide 200 and the coupling waveguide 300 also changes, and then, in addition to the change of the degree of coupling described above, the radiation characteristics can be adjusted in a wide range and in detail.

Furthermore, in the above embodiment, although the case where the E-plane of the coupling waveguide makes a fixed acute angle with the plane surface (H-plane) perpendicular to the E-plane of the feed waveguide was described, as shown in FIGS. 9A to 9D, even if the E-plane of the coupling waveguide is perpendicular to or parallel to the surface perpendicular to the E-plane of the feed waveguide, the above structure can be applied and the above effect can be obtained.

Figure 9A:
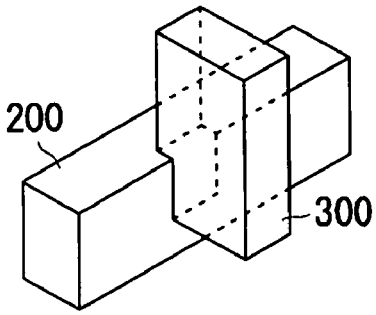
FIGS. 9A and 9B are partial schematic illustrations showing another structure of the waveguide horn antenna array of the present invention.
Figure 9B:
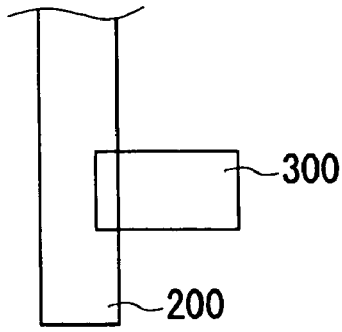
Figure 9C:
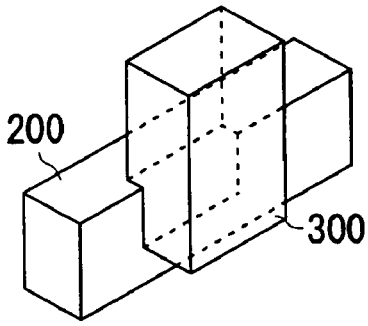
FIGS. 9C to 9D are partial schematic illustrations showing another structure of the waveguide horn antenna array of the present invention.
Figure 9D:
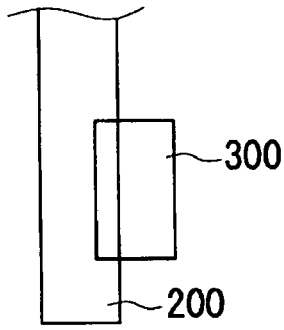

FIGS. 9A to 9D are partial schematic illustrations showing other structures of the waveguide horn antenna array of the present invention. FIGS. 9A and 9B show the case where the surface perpendicular to the E-plane of the feed waveguide 200 is perpendicular to the E-plane of the coupling waveguide 300, and FIGS. 9C and 9D show the case where the surface perpendicular to the E-plane of the feed waveguide 200 is parallel to the E-plane of the coupling waveguide 300.

In such structures, an electromagnetic wave being transmitted by the feed waveguide leaks to the coupling waveguide 300 from the coupling portion between the feed waveguide 200 and the coupling waveguide 300, and the electromagnetic wave is transmitted to the coupling waveguide 300 from the feed waveguide 200.

In this way, in the waveguide horn antenna array of the present embodiment, independently of the angle made by the feed waveguide and the coupling waveguide, a waveguide horn antenna array having a simple structure and radiation characteristics in a wide range can be constructed. That is, independently of the polarization direction of the feed waveguide, an electromagnetic wave having a desired polarization can be radiated.

Furthermore, in the above description, the use of a coupling waveguide in which the four inner surfaces of the waveguide extend in a two-dimensional plane has been described. However, as shown in FIG. 10, the above structure can be applied to a coupling waveguide being twisted and having the center in the extending direction as an axis, and the above-described effect can be obtained.

Figure 10:
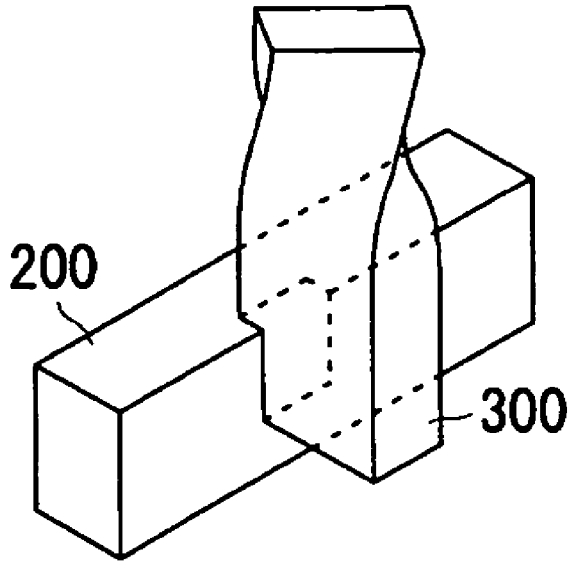
FIG. 10 shows an example of another structure of the present invention.

FIG. 10 is a general idea showing an example of another structure of the present embodiment.

As shown in FIG. 10, in a waveguide horn antenna array having such a structure, the coupling waveguide 300 is twisted in such a way that, at the end portion, on the side coupled to the feed waveguide 200, of the coupling waveguide 300, the direction of the long side of the opening surface of the coupling waveguide 300 is perpendicular to the H-plane of the feed waveguide 200, and that, at the end portion on the side of the horn (not illustrated), the direction of the long side of the opening surface of the coupling waveguide 300 makes an acute angle with the H-plane of the feed waveguide 200.

Even if a waveguide horn antenna has such a structure, the above-described structure can be applied and the above-described effect can be obtained.

Next, a manufacturing method and characteristics of the above-described waveguide horn antenna array are described with reference to FIGS. 11A to 11C and FIGS. 12A and 12B.

Figure 11A:
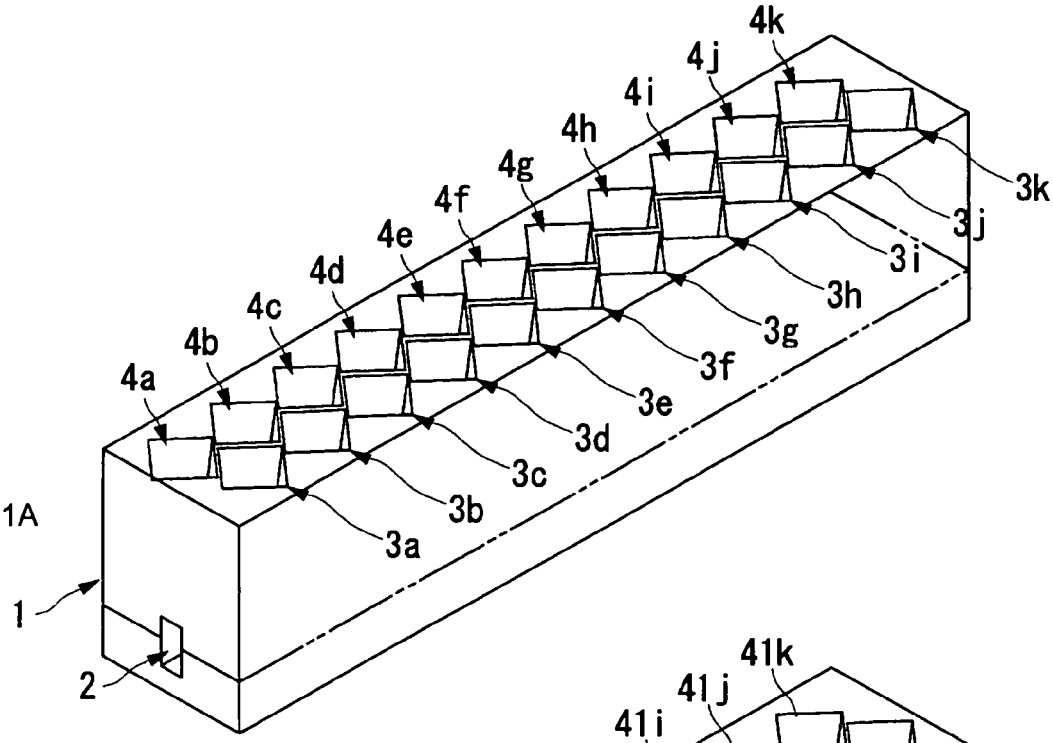
FIGS. 11A to 11C are an external perspective view and exploded perspective views showing another structure of the waveguide horn antenna array of the present invention.
Figure 11B:
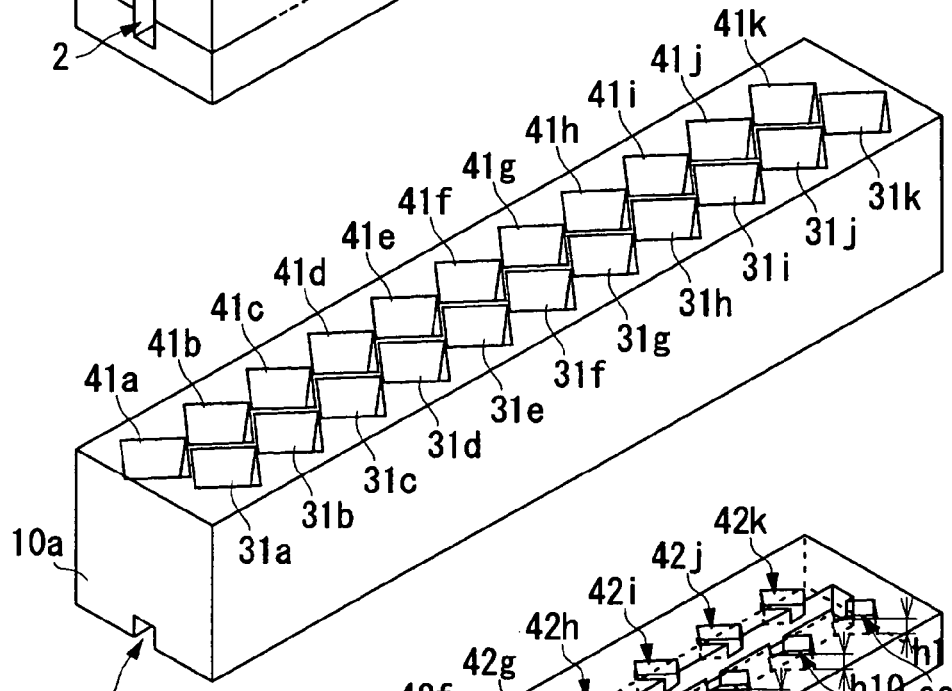
Figure 11C:
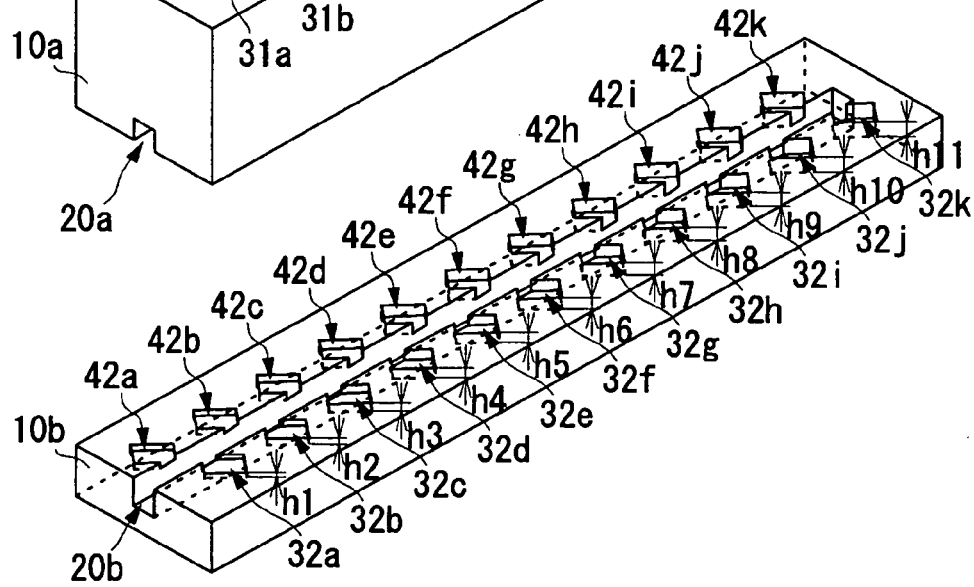

FIGS. 11A to 11C are an external perspective view and exploded perspective views showing the structure of parts of the waveguide horn antenna array of the present embodiment, FIG. 11A is an external perspective view of the waveguide horn antenna array, FIG. 11B is an external perspective view of an upper conductor plate 10*a*, and FIG. 11C is an external perspective view of a lower conductor plate 10*b*.

Figure 12A:
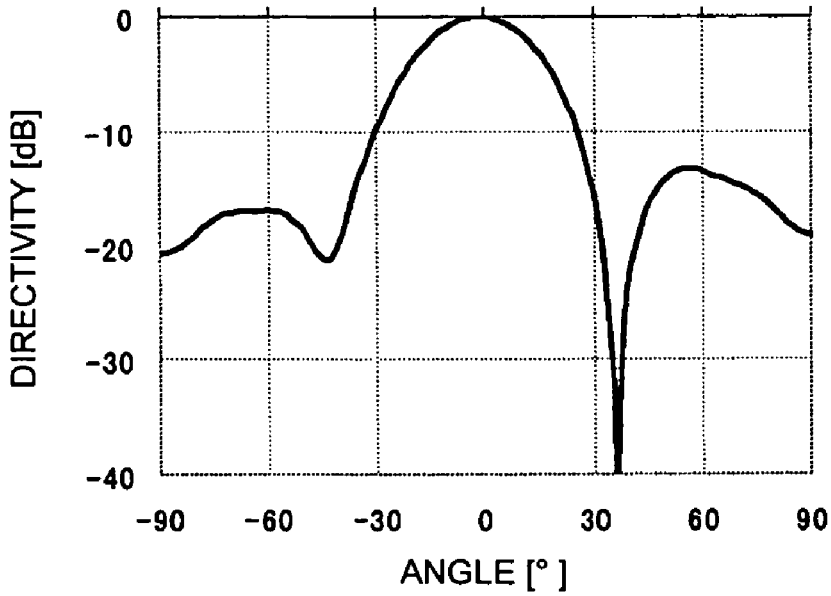
FIGS. 12A and 12B show antenna characteristics of the waveguide horn antenna array having the structure shown in FIGS. 11A to 11C.
Figure 12B:
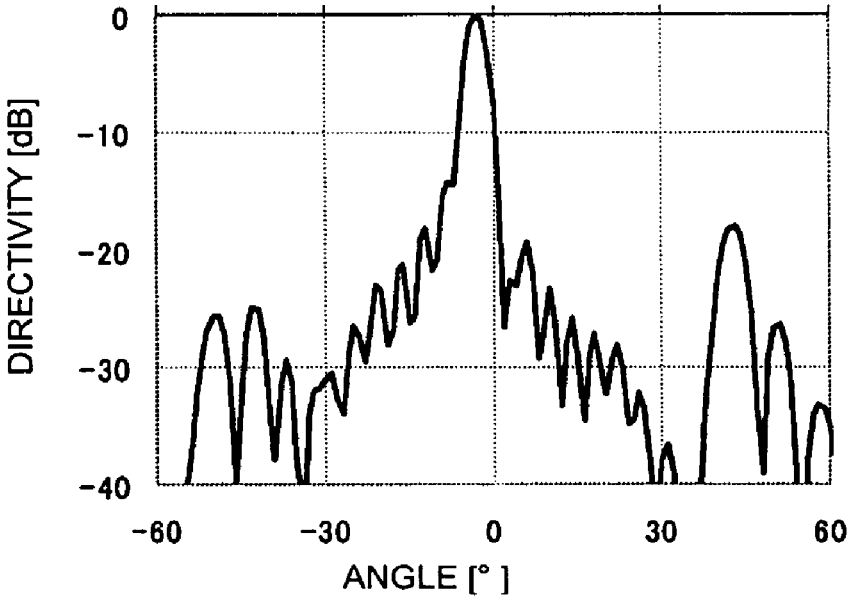

FIGS. 12A and 12B show antenna characteristics of the waveguide horn antenna array having the structure shown in FIGS. 11A to 11C, FIG. 12A shows the directivity of the horizontal direction as the arrangement direction of the waveguide horn antenna, and FIG. 12B shows the directivity in the direction perpendicular to the arrangement direction.

Moreover, since each of the horn antennas 3*a* to 3*k* and 4*a* to 4*k* has the same structure as that of the horn antenna shown in FIGS. 1 and 2, the description of the structure thereof is omitted.

As shown in FIGS. 11A to 11C, the conductor member 1 is composed of an upper conductor plate 10*a* and a lower conductor plate 10*b*.

A groove 20*a* extending in a fixed direction and having a fixed width and a fixed depth is formed on one surface of the upper conductor plate 10*a*. The width of the groove 20*a* is formed so as to be the length in the direction of the short side of the feed waveguide 2 by setting the groove 20*a* opposite to a groove 20*b*, to be described later, formed in the lower conductor plate 10*b*, and the depth of the groove 20*a* is formed so that the total length of the depth of the groove 20*a* and the depth of the groove 20*b* may become the length in the direction of the long side of the feed waveguide 2 by setting the groove 20*a* opposite to the groove 20*b* formed in the lower conductor plate 10*b*. Furthermore, the length in the extending direction is formed so that the horn antennas 3*a* to 3*k* and 4*a* to 4*k* may be formed at an interval of the wavelength in the waveguide and the length may extend a fixed distance farther from the end of the horn antennas 3*a* to 3*k* and 4*a* and 4*k*.

In the horns 31*a* to 31*k* and 41*a* to 41*k* of the horn antennas 3*a* to 3*k* and 4*a* to 4*k*, the surface opposite to the surface where the groove 20*a* is formed is made an opening surface, the horns are formed so that the area of the section may be gradually reduced, and the axial direction is perpendicular to the extending direction of the groove 20*a*.

The coupling waveguides 32*a* to 32*k* and 42*a* to 42*k* of the horn antennas 3*a* to 3*k* and 4*a* to 4*k* are formed as through-holes connected to the horns 31*a* to 31*k* and 41*a* to 41*k*, the shape of the opening surface is rectangular, the length in the direction of the long side is substantially equal to the length in the direction of the long side of the opening surface of the feed waveguide 2, and the length in the direction of the short side is made substantially equal to the length in the direction of the short side of the opening surface of the feed waveguide 2. Furthermore, the coupling waveguides 32*a* to 32*k* and 42*a* to 42*k* are formed at a position partially related to the groove 20*a*, that is, the coupling waveguides 32*a* to 32*k* and 42*a* to 42*k* are formed to partially cut in the groove 20*a*. Furthermore, the coupling waveguides 32*a* to 32*k* and 42*a* to 42*k* are formed in the extending direction of the groove 20*a* so as to be at an interval of about one half of the wavelength of the feed waveguide 2, and neighboring coupling waveguides in the extending direction are formed at positions displaced in the width direction of the groove 20*a*. That is, the coupling waveguides 32*a* to 32*k* and 42*a* to 42*k* are formed in a zigzag pattern in the extending direction of the groove 20*a* in the order of 32*a*, 42*a*, 32*b*, 42*b*, . . . , 32*k*, and 42*k*.

The upper conductor plate 10*a* containing the groove 20*a*, horn antennas 3*a* to 3*k* and 4*a* to 4*k* is formed in such a away that, after a conductor plate has been made by machining of metals, die casting, resin molding, and ceramic mold casting, conductor plating is performed on the conductor plate.

The groove 20*b* is formed on one surface of the lower conductor plate 10*b* so as to be opposite to the groove 20*a* of the upper conductor plate 10*a*, and the width and the length in the extending direction are the same as the groove 20*a*. Regarding the depth of the groove 20*b* set opposite to the groove 20*a*, the total length of the depth of the groove 20*a* and the depth of the groove 20*b* are formed so as to be the length in the direction of the long side of the feed waveguide 2.

Furthermore, a part of the coupling waveguides 32*a* to 32*k* and 42*a* to 42*k* is formed on the surface, having the groove 20*b* formed thereon, of the lower conductor plate 10*b*, and the lengths in the direction of the long side and in the direction of the short side of the opening surface and the formed position are the same as the coupling waveguides 32*a* to 32*k* and 42*a* to 42*k* formed on the upper conductor plate 10*a*. In this way, when the surfaces having the grooves 20*a* and 20*b* formed thereon of the upper conductor plate 10*a* and the lower conductor plate 10*b* are made in contact with each other, desired coupling waveguides 32*a* to 32*k* and 42*a* to 42*k* are constructed. At this time, the depths h1 to h11, etc., of the coupling waveguides 32*a* to 32*k* and 42*a* to 42*k* to be formed in the lower conductor plate 10*b* are appropriately set in accordance with the degree of coupling to the feed waveguide 2. For example, as shown in FIG. 11, since a desired radiation capability is available with a small degree of coupling in the coupling waveguides 32*a* to 42*a* on the input side of the feed waveguide 2 where the transmission electronic energy is large, the depth h1 of the coupling waveguide 32*a* formed in the lower conductor plate 10*b* becomes relatively shallow. On the other hand, when a large degree of coupling is not available in the coupling waveguides 32*k* and 42*k* in the vicinity of the end portion of the feed waveguide 2 where the transmission electric energy is small, since the radiation power equivalent to the coupling waveguide 32*a*, etc., on the input side is not available, the depth h11 of the coupling waveguide 32*k*, etc., formed in the lower conductor plate 10*b* becomes relatively deep. Thus, the radiation characteristics on the input side of the feed waveguide 2 can be made substantially in agreement with the radiation characteristics on the termination side.

Moreover, when the depths of the coupling waveguides 32*a* to 32*k* and 42*a* to 42*k* formed in the lower conductor plate 10*b* are appropriately set, the directivity of an electromagnetic wave radiated from the horn antennas 3*a* to 3*k* and 4*a* to 4*k* can be set. For example, when a strong directivity in the front direction from the center in the arrangement direction of the waveguide horn antenna is desired, the depth of the coupling waveguides 32*e*, 32*f*, 42*e*, and 42*f* in the vicinity of the center in the arrangement direction is set to be large.

The example of characteristics of a waveguide horn antenna array formed by using such two conductor plates will now be described. FIGS. 12A and 12B show the antenna characteristics of a waveguide horn antenna array having the structure shown in FIGS. 11A to 11C. Moreover, the set conditions under which the antenna characteristics shown FIGS. 12A and 12B were observed are, first, that the antenna operates in the 76 GHz to 77 GHz band, the number of horn antennas is 22 (having the structure in FIGS. 11A to 11C), and the distribution of opening areas of the horn antennas is a Gaussian distribution, that is, the distribution of $\exp(-c((i/N-1/2)^2)$ where c=1.0. The polarized wave of the horn antennas is a 45-degree linear polarized wave. Furthermore, the feed waveguide and the coupling waveguides have a size of 2.54 mm×1.27 mm in (the length in the direction of the long side)×(the length in the direction of the short side), and the space in the extending direction of the coupling waveguides of the horn antennas is 2.7 mm. Regarding the shape of the horn antenna, the opening area is 3.5 mm×3.5 mm and the height of the horn is 3.7 mm. Moreover, the combined upper conductor plate 10*a* and lower conductor plate 10*b* are 10 mm in height, the upper conductor plate 10*a* is 7 mm in height, and the lower conductor plate 10*b* is 3 mm in height.

The measurement has been carried out under such conditions and, as a result, regarding the waveguide horn antenna array of the present embodiment, the antenna gain is 22.7 dB, the beam width in the vertical direction is 3.7 degrees, the beam width in the horizontal direction is 32.5 degrees, and the worst return loss is −22 dB, and, when compared with the related one, antenna characteristics of a high efficiency can be obtained. In this way, when the structure of the present embodiment is used, a waveguide horn antenna array having a simple structure, being easily manufactured and adjusted, and having a wide range of adjustment of the degree of coupling can be constructed.

Figure 13:
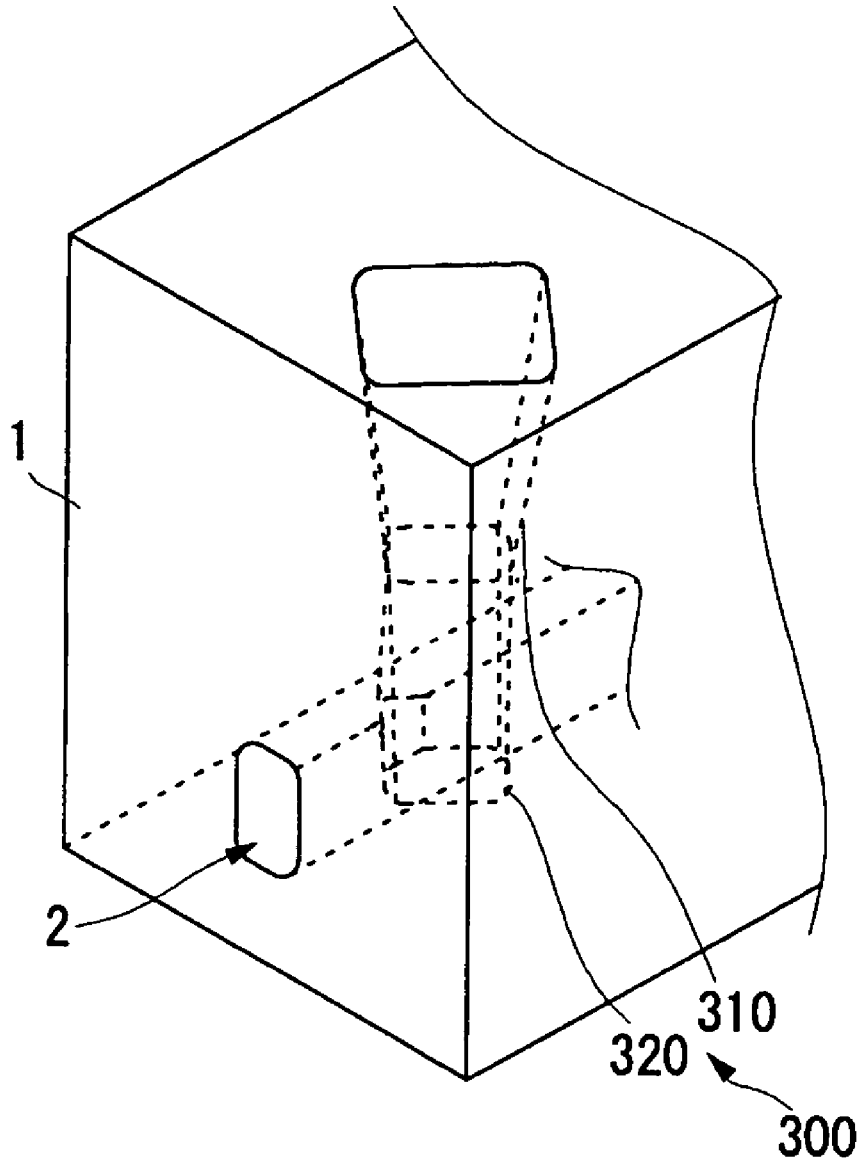
FIG. 13 shows a partial structure of a waveguide horn antenna array using a waveguide of an elliptical opening surface.

Now, in each of the waveguide horn antenna arrays described above, an example using a rectangular waveguide having a rectangular opening surface is described, but, even if a waveguide horn antenna array having the structure in which a circular waveguide of a circular opening surface and a circular horn are used, and even if a rectangular coupling waveguide 320, feed waveguide 2, and horn antenna 310 having a tapered opening surface as shown in FIG. 13 are used, the above-described structure and effect can be obtained.

FIG. 13 shows a partial structure of a waveguide horn antenna array using a rectangular waveguide having a tapered opening surface.

When constructed in this way, since the above effect can be obtained and the corner portions of the waveguide and horn are rounded, the casting processing becomes easy and the waveguide horn antenna array becomes easy to manufacture.

Figure 14A:
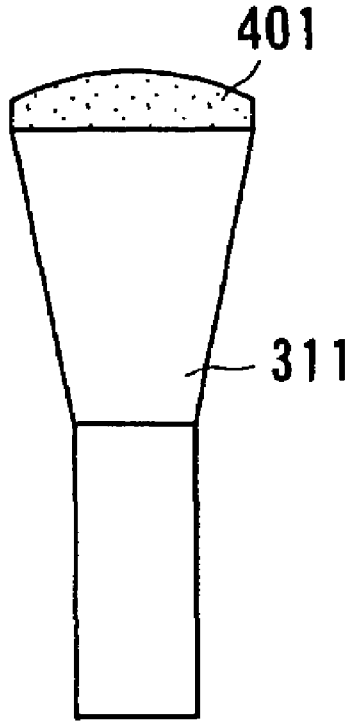
FIGS. 14A is a side view showing the state where a dielectric material is put on the tip of the horn.
Figure 14B:
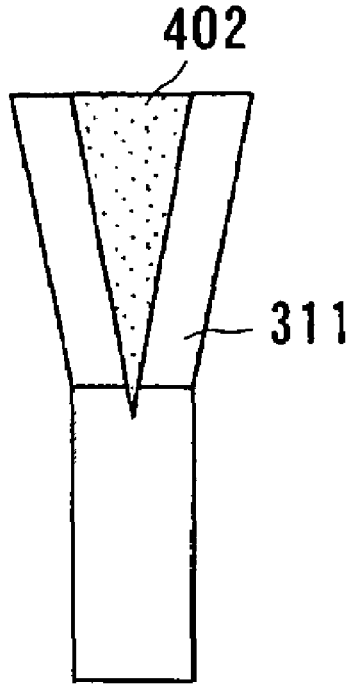
FIG. 14B is a side view showing the state where a dielectric material is put on the tip of the horn.

Furthermore, in the structure of each of the above-described waveguide horn antenna arrays, although nothing is attached to the opening surface of the horn, a dielectric material may be put on that as shown in FIGS. 14A and 14B.

FIGS. 14A and 14B are side views showing the state where a dielectric material is put on the tip of the horn. FIG. 14A shows the structure in which a dielectric lens 401 is attached on the opening surface of a horn 311, and FIG. 14B shows the structure in which a dielectric member 402 similar to the shape of the horn is attached inside the horn 311.

These dielectric materials are made of a material and shape for increasing the directivity of an electromagnetic wave radiated from the horn. For example, concretely, in the structure of the dielectric lens 401 in FIG. 14A, when polypropylene is used as a dielectric material and a lens having the maximum thickness of 2.5 mm and focal distance of 3.7 mm is used in the opening surface (3.5 mm×3.5 mm) of the horn is used, the antenna gain can be improved by 1.7 dB in comparison with the case where no dielectric is attached.

Figure 15A:
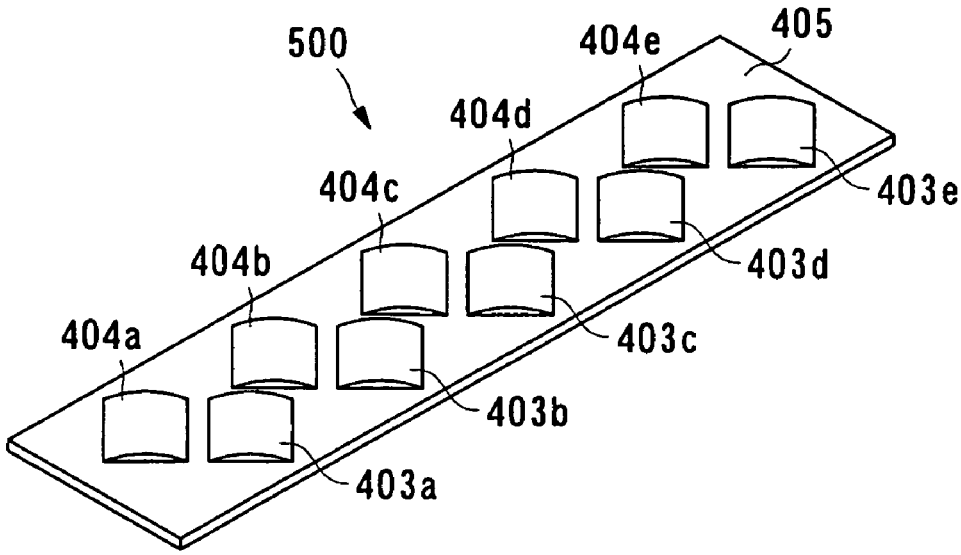
FIGS. 15A and 15B are an external perspective view and a partial sectional side view, both showing the structure of a dielectric lens member having a plurality of dielectric lenses integrally formed.
Figure 15B:
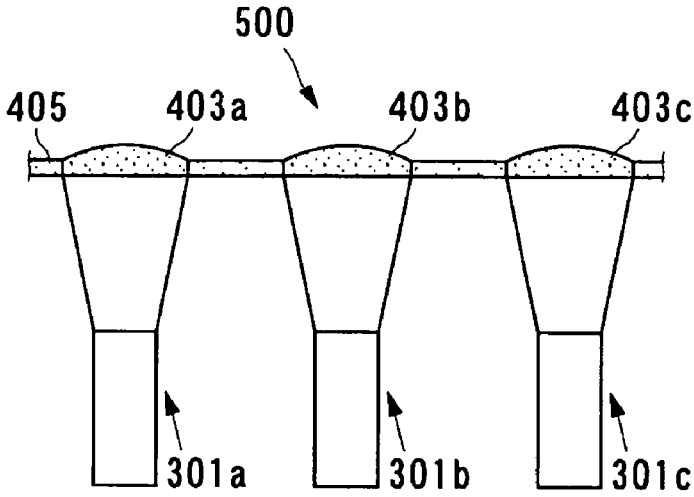

Moreover, as shown in FIGS. 15A and 15B, the dielectric lenses which are attached to the opening surfaces of a plurality of horn antennas arranged may be integrally formed.

FIG. 15A is an external perspective view showing the structure of a dielectric lens member having a plurality of dielectric lenses integrally formed, and FIG. 15B is a partial sectional side view of the dielectric lens member shown in FIG. 15A.

As shown in FIGS. 15A and 15B, a dielectric lens member 500 is composed of dielectric lenses 403*a* to 403*e* and 404*a* to 404*e*, each of which is formed as a convex lens and which are arranged in a space of attached horns, and a connection position 405 integrating the dielectric lenses. Then, the dielectric lenses 403*a* to 403*e* and 404*a* to 404*e* are attached to the opening surface of the horns and fixed. When constructed in this way, the directivity of each horn antenna of the waveguide horn antenna array increases and the waveguide horn antenna array has a high gain, and, as a result, the antenna characteristics are improved. At this time, since only the dielectric lens is attached to the opening surface of the horn antenna, the antenna characteristics can be improved by increasing the external shape of only the dielectric lens member.

Next, the structure of a radar device using the above-described waveguide horn antenna arrays is described with reference to FIGS. 16A and 16B, and FIG. 17.

Figure 16A:
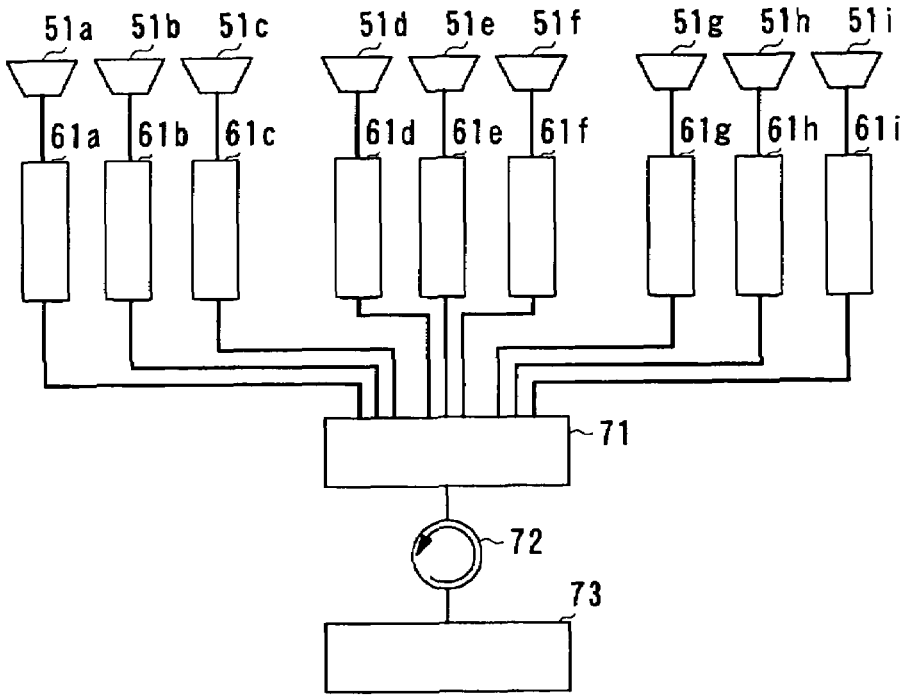
FIG. 16A is a schematic view showing the structure of a radar device.
Figure 16B:
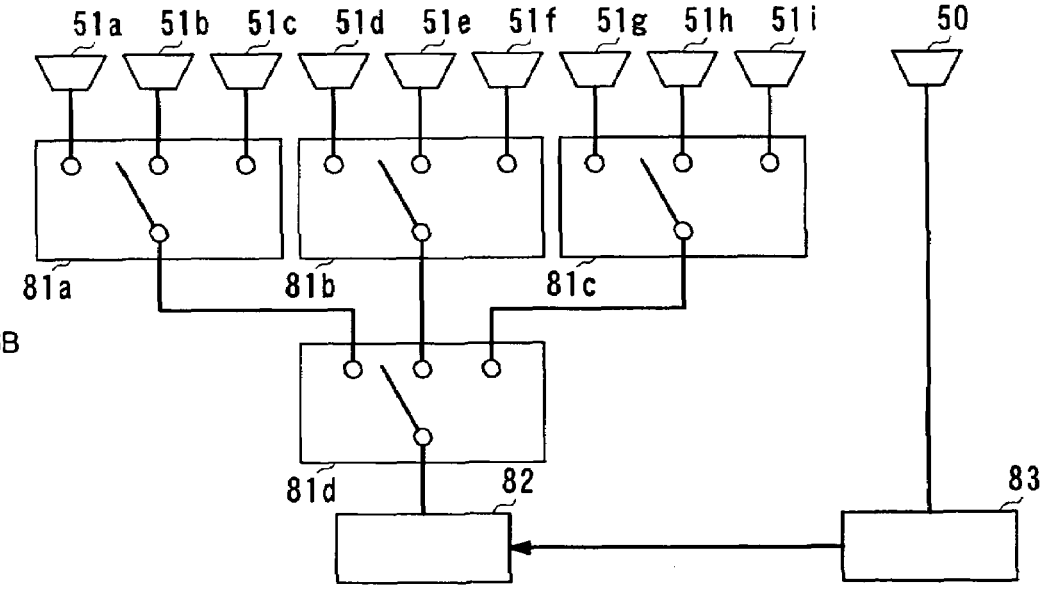
FIG. 16B is a schematic view showing the structure of a radar device.
Figure 17:
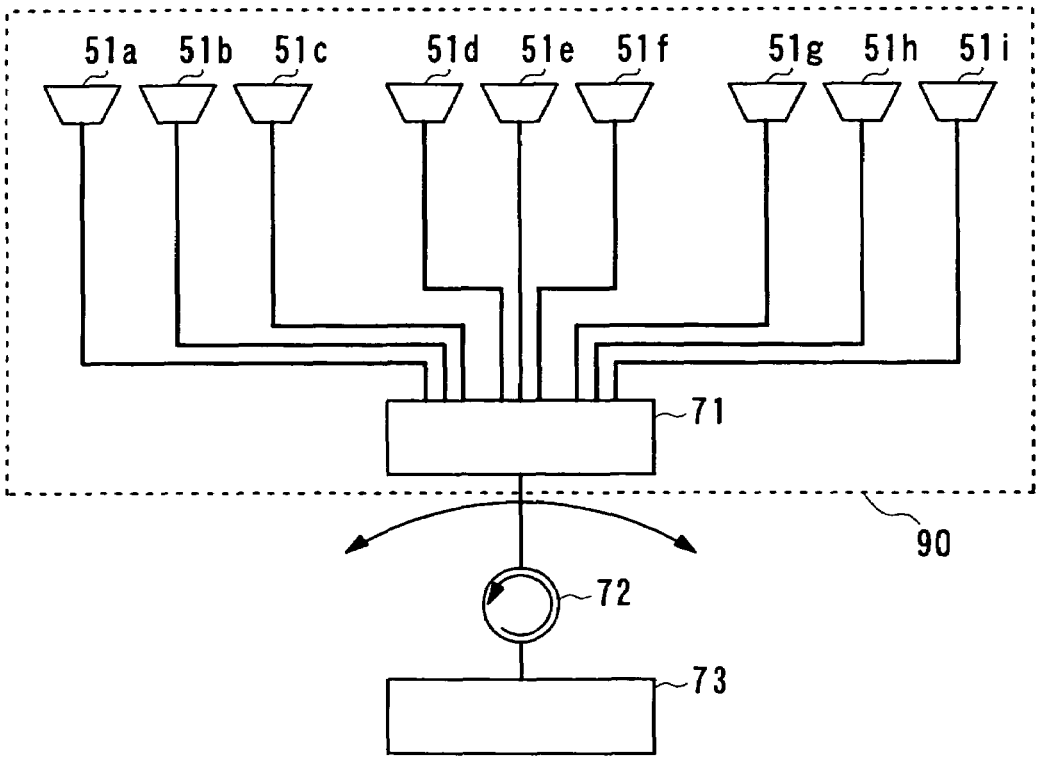
FIG. 17 is a schematic view showing the structure of a radar device.

FIGS. 16A and 16B, and FIG. 17 are schematic views showing various structures of the radar device, FIG. 16A is a radar device having a variable phase shifter, FIG. 16B is a radar device having a switch, and FIG. 17 is a radar device having a shifting mechanism.

The radar device shown in FIG. 16A contains a plurality of waveguide horn antenna arrays 51*a* to 51*i*, phase shifters 61*a* to 61*i*, a branch circuit 71, a circulator 72, and a transmitter/receiver 73. The plurality of waveguide horn antennas 51*a* to 51*i* each are formed by using a waveguide horn antenna array having the above structure and arranged in parallel so that the array direction of the horn antennas may be substantially in agreement. The phase shifters 61*a* to 61*i* each are connected to the plurality of waveguide horn antennas 51*a* to 51*i*, and, since a sending beam and receiving beam having the directivity in a fixed direction are formed, the phase of a transmission signal radiated from each of the waveguide horn antennas 51*a* to 51*i* and a reception signal received by each is adjusted. The branch circuit 71 branches the transmission signal input from the circulator 72 to the phase shifters 61*a* to 61*i* and the reception signal input from each of the phase shifters 61*a* to 61*i* is output to the circulator 72. The circulator 72 transmits the transmission signal from the transmitter/receiver 73 to the branch circuit 71 and transmits the reception signal from the branch circuit 71 to the transmitter/receiver 73. The transmitter/receiver 73 generates a transmission signal and outputs the signal to the circulator 72, and obtains a target detection information from the reception signal input from the circulator 72. In such a radar device, a radar detection in a fixed direction is realized by appropriately setting the phase condition of the transmission signal to be output to each of the waveguide horn antenna arrays 51*a* to 51*i* through the phase shifters 61*a* to 61*i* and the phase condition of the input reception signal. Then, a downsized radar device having a simple structure can be constructed by using the above waveguide horn antenna array.

The radar device shown in FIG. 16B contains a waveguide horn antenna array 50 for transmission, a plurality of waveguide horn antenna arrays 51*a* to 51*i* for reception, switching circuits 81*a* to 81*d*, a receiver 82, and a transmitter 83. The transmitter 83 generates a transmission signal and outputs the signal to the waveguide horn antenna array 50 for transmission, and outputs the transmission signal or a reference signal in conformance with the signal to the receiver 82. The waveguide horn antenna array 50 for transmission radiates the transmission signal from the transmitter 83 to the outside. The plurality of waveguide horn antennas 51*a* to 51*i* for reception each are formed by the waveguide horn antenna array having the above-described structure and arranged in parallel so that the array direction of the horn antennas may be substantially in agreement. The plurality of waveguide horn antenna arrays 51*a* to 51*i* for reception receives the signal output from the waveguide horn antenna array 50 for transmission and reflected and outputs the reception signal to the switching circuits 81*a* to 81*c* to which each has been connected. The switching circuit 81*a* is connected to the waveguide horn antenna arrays 51*a* to 51*c* and simultaneously connected to the switching circuit 81*d*, and the connection between the switching circuit 81*d* and any one of the waveguide horn antennas 51*a* to 51*c* is switched. The switching circuit 81*b* is connected to the waveguide horn antenna arrays 51*d* to 51*f* and simultaneously connected to the switching circuit 81*d*, and the connection between the switching circuit 81*d* and any one of the waveguide horn antennas 51*d* to 51*f* is switched. The switching circuit 81*c* is connected to the waveguide horn antenna arrays 51*g* to 51*i* and simultaneously connected to the switching circuit 81*d*, and the connection between the switching circuit 81*d* and any one of the waveguide horn antennas 51*g* to 51*i* is switched. The switching circuit 81*d* is connected to the switching circuits 81*a* to 81*c* and simultaneously connected to the receiver 82, and the connection between the receiver 82 and any one of the switching circuits 81*a* to 81*c* is switched. In the radar device having such a structure, a radar detection in a fixed direction is realized by switching the waveguide horn antenna array receiving a reflection signal using the switching circuits 81*a* to 81*d*. For example, when a radar detection by a reflection signal received by the waveguide horn antenna array 51*a* is performed, the receiver 82 and the switching circuit 81*a* are connected by the switching circuit 81*d*, and the switching circuit 81*d* and the waveguide horn antenna array 51*a* are connected by the switching circuit 81*a*, and then, the reception signal received by the waveguide horn antenna array 51*a* is transmitted to the receiver 82. Then, also in the radar device having such a structure, a downsized radar device having a simple structure can be constructed by using the structure of the above waveguide horn antenna array.

The radar device shown in FIG. 17 contains a plurality of waveguide horn antenna arrays 51*a* to 51*i*, a branch circuit 71, a circulator 72, a transmitter/receiver 73, and a rocking device 90 having the plurality of waveguide horn antenna arrays 51*a* to 51*i* and the branch circuit 71 and rocking in a fixed direction. In this radar device, the phase shifters 61*a* to 61*i* in the radar device shown in FIG. 16A are omitted, and the basic operation of the transmission/reception excluding the phase adjustment is the same as the radar device shown in FIG. 16A. In this radar device, the plurality of waveguide horn antenna arrays 51*a* to 51*i* are moved to the direction in which a beam is required by the rocking device 90 in order to make a sending beam and receiving beam in a fixed direction. Thus, the directivity in a fixed direction is realized and a radar detection is performed. And, also in the radar device having such a structure, a downsized radar device having a simple structure can be constructed by using the structure of the above waveguide horn antenna arrays.

Figure 18A:
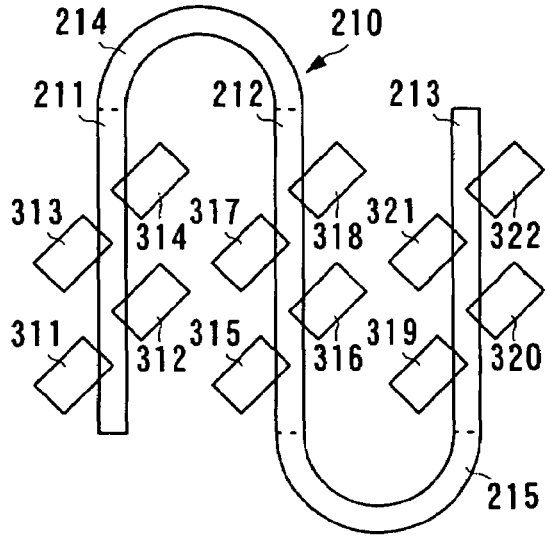
FIG. 18A is a schematic view showing a horn antenna arrangement pattern of a waveguide horn antenna array arranged on a plane surface.
Figure 18B:
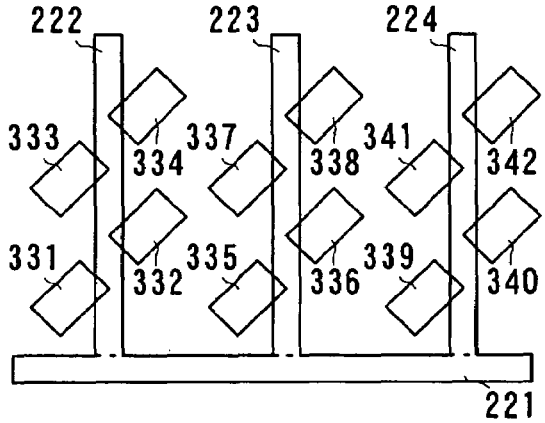
FIG. 18B is a schematic view showing a horn antenna arrangement patterns of a waveguide horn antenna array arranged on a plane surface.
Figure 18C:
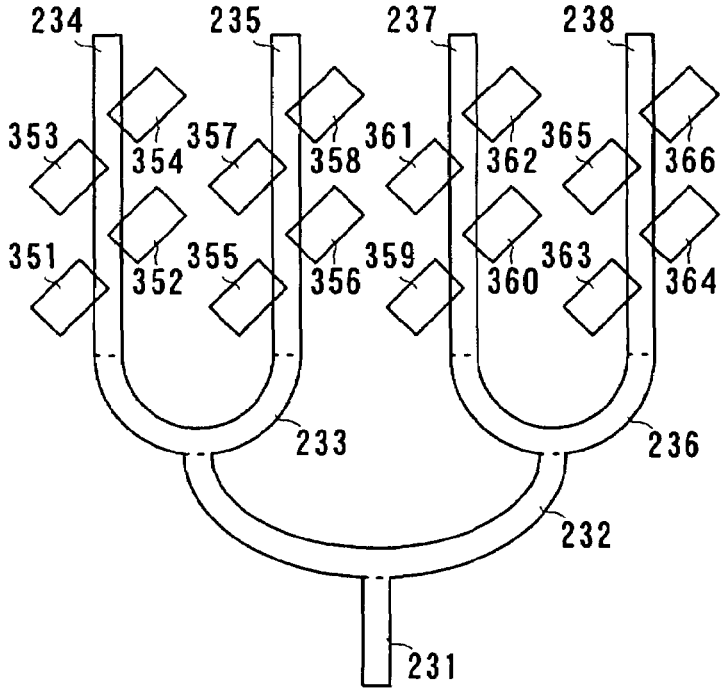
FIG. 18C is a schematic view showing horn antenna arrangement pattern of a waveguide horn antenna array arranged on a plane surface.

Now, in the above description, although the waveguide horn antenna arrays which are in a zigzag, but which are arranged substantially in a straight line in a fixed direction were shown, as shown in FIGS. 18A to 18C, each horn antenna may be arranged in a plane surface of a fixed area.

FIGS. 18A to 18C are schematic views showing the horn antenna arrangement patterns of a waveguide horn antenna array arranged on a plane surface.

The waveguide horn antenna arrays shown in FIG. 18A contains three parallel linear feed waveguides 211, 212, and 213 and a substantially S-shaped feed waveguide 210 made of a curved feed waveguide 214 connected to the linear feed waveguides 211 and 212, the curved feed waveguide 214 having a fixed curvature radius and a curved feed waveguide 215 connected to the linear feed waveguides 212 and 213, the curved feed waveguide 215 having the fixed curvature radius. The linear feed waveguides 211, 212, and 213 are disposed in the direction perpendicular to the extending direction of the linear feed waveguides 211, 212, and 213 so as to have the same space therebetween. Furthermore, in the linear feed waveguide 211, horn antennas 311 to 314 are set in a zigzag in the direction of the feed waveguide 211; in the linear feed waveguide 212, horn antennas 315 to 318 are set in a zigzag in the direction of the feed waveguide 212; and, in the linear feed waveguide 213, horn antennas 319 to 322 are set in a zigzag in the direction of the feed waveguide 213. The coupling structure of the horn antennas 311 to 314, 315 to 318, 319 to 322 to the linear feed waveguides 211, 212, and 213 is the same as in the above-described waveguide horn antenna arrays. At this time, when the position of the horn antennas 311 to 314, 315 to 318, and 319 to 322 set in the linear feed waveguides 211, 212, and 213 is arranged proportionately with the arrangement direction of the linear feed waveguides 211, 212, and 213, a plane horn antenna arrangement can be realized. For example, in the case of FIG. 18A, when the arrangement direction of the horn antennas 311, 315, and 319, the arrangement direction of the horn antennas 312, 316, and 320, the arrangement direction of the horn antennas 313, 317, and 321, and the arrangement direction of the horn antennas 314, 318, and 322 are made in agreement with the arrangement direction of the linear feed waveguides 211, 212, and 213, a plane horn antenna arrangement can be realized. When constructed in this way, since a beam having a fixed directivity is formed by the horn antennas of plane arrangement, a pencil type beam can be easily formed.

The waveguide horn antenna arrays shown in FIG. 18B contains linear local feed waveguides 222, 223, and 224 in which horn antennas 331 to 334, horn antennas 335 to 338, and horn antennas 339 to 342 are set, and a linear main feed waveguide 221 connected to the feed waveguides. The local feed waveguides 222, 223, and 224 are set with a fixed space in the extending direction of the main feed waveguide 211, and the extending direction of the local feed waveguides 222, 223, and 224 is perpendicular to the extending direction of the main feed waveguide 221. The coupling structure of horn antennas 331 to 334, 335 to 338, and 339 to 342 to the local feed waveguides 222, 223, and 224 is the same as in the above-described waveguide horn antenna arrays. At this time, when the position of the horn antennas 331 to 334, 335 to 338, and 339 to 342 set in the linear feed waveguides 222, 223, and 224 is arranged proportionately with the arrangement direction of the linear feed waveguides 222, 223, and 224, a plane horn antenna arrangement can be realized. For example, in the case of FIG. 18B, the arrangement direction of the horn antennas 331, 335, and 339, the arrangement direction of the horn antennas 332, 336, and 340, the arrangement direction of the horn antennas 333, 337, and 341, and the arrangement direction of the horn antennas 334, 338, and 342 are made in agreement with the arrangement direction of the linear feed waveguides 222, 223, and 224, a plane horn antenna arrangement can be realized. When constructed in this way, since a beam of a fixed directivity is formed by the horn antennas of plane arrangement, a pencil type beam can be easily formed.

The waveguide horn antenna arrays shown in FIG. 18C contains linear local feed waveguides 234, 235, 237, and 238 in which horn antennas 351 to 354, horn antennas 355 to 358, horn antennas 359 to 362, and horn antennas 363 to 366 are set, a branch feed waveguide 233 connecting local feed waveguides 234 and 235, a branch feed waveguide 236 connecting local feed waveguides 237 and 238, a branch feed waveguide 232 connecting local feed waveguides 233 and 236, and a main feed waveguide connected to the branch feed waveguide 232. The extending direction of the local feed waveguides 234, 235, 237, and 238 is in agreement with each other and the local feed waveguides 234, 235, 237, and 238 are disposed at equal spaces in the direction perpendicular to the extending direction. The coupling structure of horn antennas 351 to 354, 355 to 358, 359 to 362, and 363 to 366 to the local waveguides 234, 235, 237, and 238 is the same as in the above waveguide horn antenna arrays. At this time, the position of the horn antennas 351 to 354, 355 to 358, 359 to 362, and 363 to 366 set in the linear feed waveguides 234, 235, 237, and 238 is arranged proportionately with the arrangement direction of the local feed waveguides 234, 235, 237, and 238, a plane horn antenna arrangement can be realized. For example, in the case of FIG. 18C, the arrangement direction of the horn antennas 351, 355, 359, and 363, the arrangement direction of the horn antennas 352, 356, 360, and 364, the arrangement direction of the horn antennas 353, 357, 361, and 365, and the arrangement direction of the horn antennas 354, 358, 362, and 366 are made in agreement with the arrangement direction of the local feed waveguides 234, 235, 237, and 238, and then, a plane horn antenna arrangement can be realized. Since the structure is of the so called corporate feed method, even if constructed in this way, since a beam having a fixed directivity can be formed by the horn antennas of plane arrangement, a pencil type beam can be formed.

While preferred embodiments of the invention have been described above, it is to be understood that variations and modifications will be apparent to those skilled in the art without departing the scope and spirit of the invention. The scope of the invention, therefore, is to be determined solely by the following claims.

What is claimed is:

1. A waveguide horn antenna array comprising:

a feed waveguide; and a plurality of horn antennas, each horn antenna having a coupling waveguide with an electromagnetic wave propagation direction perpendicular to an electromagnetic wave propagation direction of the feed waveguide, and having a horn portion coupled to a first end portion of the coupling waveguide opposite the feed waveguide, wherein the plurality of horn antennas are set in a predetermined arrangement relative to the feed waveguide, and wherein a second end portion of the coupling waveguide, opposite the first end portion, is at least partially protruded into the feed waveguide in a direction perpendicular to an extending direction of the feed waveguide.

2. A waveguide horn antenna array as claimed in claim 1:

wherein an opening surface of the feed waveguide has a long side and a short side perpendicular to an extending direction of the coupling waveguide, an opening surface of each of the coupling waveguides has a long side and a short side perpendicular to the extending direction of the feed waveguide, and wherein the coupling waveguides are coupled to the feed waveguide so that the direction of the long side of the feed waveguide and the direction of the long side of the coupling waveguides form a predetermined angle.

3. A waveguide horn antenna array as claimed in claim 1, wherein the coupling waveguides are disposed at an interval of about one half of a wavelength of a signal propagated in the feed waveguide in the extending direction of the feed waveguide, and neighboring coupling waveguides in the extending direction of the feed waveguide are disposed on opposite sides of the feed waveguide.

4. A waveguide horn antenna array as claimed in claim 1:

wherein the plurality of horn antennas are coupled to the feed waveguide so that the radiation direction of an electromagnetic wave is perpendicular to the E-plane of the feed waveguide, and wherein the feed waveguide is divided into two parts by the E-plane.

5. A waveguide horn antenna array as claimed in claim 1, wherein a plurality of dielectric lenses are coupled to respective opening portions of the plurality of horn antennas.

6. A waveguide horn antenna array as claimed in claim 5, wherein the plurality of dielectric lenses are integrally formed with the plurality of horn antennas.

7. A waveguide horn antenna array as claimed in claim 1, wherein a dielectric material is located on the horn portion of the plurality of horn antennas.

8. A waveguide horn antenna array as claimed in claim 7, wherein the dielectric material is attached to an opening of the horn portion.

9. A waveguide horn antenna array as claimed in claim 7, wherein the dielectric material is attached inside the horn portion.

10. A waveguide horn antenna array as claimed in claim 9, wherein the dielectric material is similar in shape to the horn portion.

11. A radar device comprising:

a waveguide horn antenna array as claimed in claim 1, wherein a target detection is performed by using an electromagnetic wave transmitted and received by the waveguide horn antenna array.

* * * * *